United States Patent [19]

Daly

[11] 4,043,439

[45] Aug. 23, 1977

[54] SERIAL PRINTING DEVICE FOR TYPEWRITERS, ACCOUNTING MACHINES, TELEPRINTERS AND SIMILAR OFFICE MACHINES

[75] Inventor: Dante Daly, Ivrea (Turin), Italy

[73] Assignee: Ing. C. Olivetti & C., S.p.A., Ivrea (Turin), Italy

[21] Appl. No.: 660,930

[22] Filed: Feb. 24, 1976

[30] Foreign Application Priority Data

Mar. 5, 1975 Italy ..... 67554/75

[51] Int. Cl.[2] ..... B41J 1/50; B41J 23/04

[52] U.S. Cl. ..... 197/18; 197/55

[58] Field of Search ..... 101/93.18, 93.19; 178/34; 197/16, 18, 48, 53, 55

[56] References Cited

U.S. PATENT DOCUMENTS

| | | | |
|---|---|---|---|
| 3,599,773 | 8/1971 | Serracchioli et al. | 197/55 |
| 3,770,095 | 11/1973 | Guerrini et al. | 197/18 |
| 3,876,053 | 4/1975 | Giolitti et al. | 197/55 X |
| 3,957,149 | 5/1976 | Salto | 197/18 X |

*Primary Examiner*—Edgar S. Burr
*Assistant Examiner*—Paul T. Sewell
*Attorney, Agent, or Firm*—Schuyler, Birch, Swindler, McKie & Beckett

[57] ABSTRACT

A serial printing device comprises a type head mounted rotatably on a carriage which is slidable along a printing line of an office machine. A continuously rotating driving shaft is connected to a differential mechanism which normally transfers the motion to the type head for the selection of the character to be printed. A selectively actuatable electromagnet arrests the rotation of the head in the printing position and simultaneously transfers the motion of the driving shaft to a striking mechanism to effect the printing of the selected character. A positioning element, commanded by the striking mechanism at the actuation of the electromagnet, keeps the head locked during the striking movement and the electromagnet is immediately deenergized. After the striking of the selected character the head is freed by the positioning element and is set in rotation again.

12 Claims, 5 Drawing Figures

SERIAL PRINTING DEVICE FOR TYPEWRITERS, ACCOUNTING MACHINES, TELEPRINTERS AND SIMILAR OFFICE MACHINES

BACKGROUND OF THE INVENTION

1. Field of the Invention

The present invention relates to a printing device for an office machine, e.g. a typewriter, accounting machine or teleprinter, of the type in which a driving means normally causes a type head to rotate and in which a change-over mechanism arrests the head, thus selecting the character to be printed, and transfers the motion of the driving means to a striking mechanism to effect the printing of the selected character, such a device being referred to herein as of the type defined.

2. Description of the Prior Art

A device of the type defined is known wherein the motion of the driving means is transferred to the head and to a striking cam by a differential which normally causes the head to rotate, the striking cam being held stationary. By means of the simultaneous energization of two electromagnets, a selector disc connected to the head is arrested to arrest the head in the angular position corresponding to the character to be printed and the striking cam is released for command of the striking of the selected character or type. This device, however, has the disadvantage of using two different means for the selection and striking operations. Moreover, while the electromagnet which commands the striking can be deenergized immediately once the striking cam with which it co-operates has been released, assuming this electromagnet to trigger a one-cycle clutch, the electromagnet which co-operates with the selector disc must remain energized until such time as the striking cycle has been completed. This requires a heavily rated and costly selector electromagnet and a fairly complex circuit capable of generating the actuating command for this electromagnet.

SUMMARY OF THE INVENTION

The object of the present invention is to provide a device of the type defined in which the arrest of the head in the selected position and the command of the striking means can be effected by means of the energization of a single electromagnet, and in which the time of this energization need only be very brief in order to contain the dissipated energy within limited values.

Another object of the present invention is to provide a device of the type defined wherein the arrest means which arrests the head in the printing position can be de-actuated before the end of the striking operation for being prearranged for a selection of another character.

BRIEF DESCRIPTION OF THE DRAWING

The invention will be described in more detail, by way of example, with reference to the accompanying drawings, wherein.

DESCRIPTION OF A PREFERRED EMBODIMENT OF THE INVENTION

Figure 1:
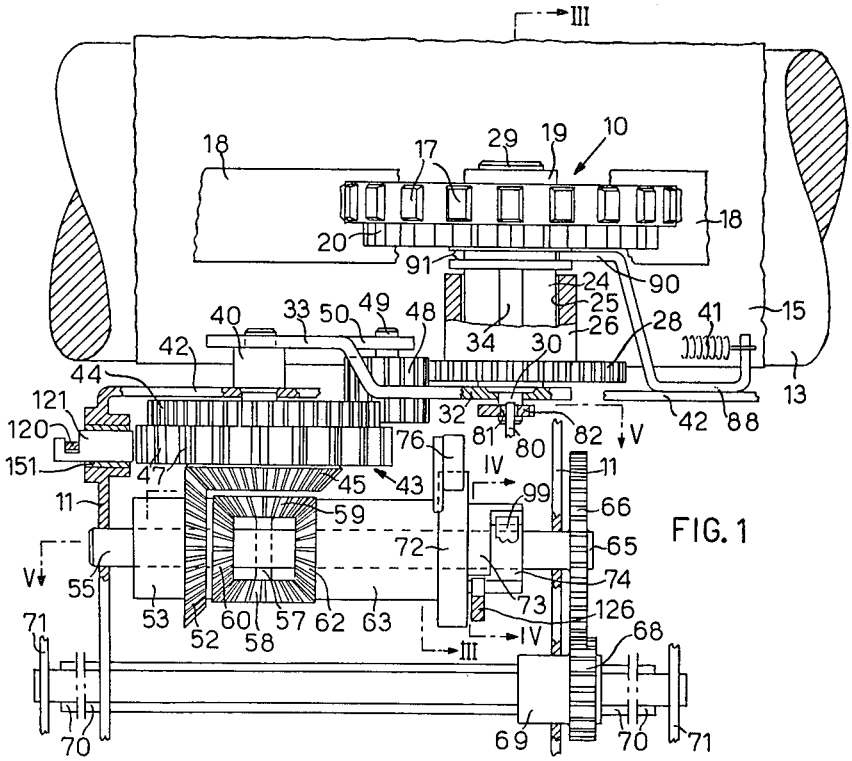
FIG. 1 is a front view of a printing device embodying the invention.

The printing device comprises a type head 10 (FIG. 1) mounted rotatably on a carriage 11 which is slidable on suitable guides, not shown in the drawing, and is movable in known manner along a printing line parallel to a platen 13 which backs a recording support 15. This support may be constituted by single sheets of paper, continuous forms, cheques or bank forms, etc.

An inked ribbon 18, which is fed in any known manner, runs between the head 10 and the platen 13. The head 10 is made of light alloy or plastics material and is shaped so as to define a hub 19 (FIG. 3), a first wheel 16, on the periphery of which a plurality of printing types or characters 17 are formed in relief, and a second wheel 20 with a diameter smaller than that of the wheel 16 and on the periphery of which a V-shaped notch 22 is formed in correspondence with each type or character 17.

The hub 19 is provided with a through central bore 23 and has a cylindrical lower portion 24 thereof seated in a corresponding cylindrical cavity 25 of a bush 26 which is integral with a gear 28.

Figure 2:
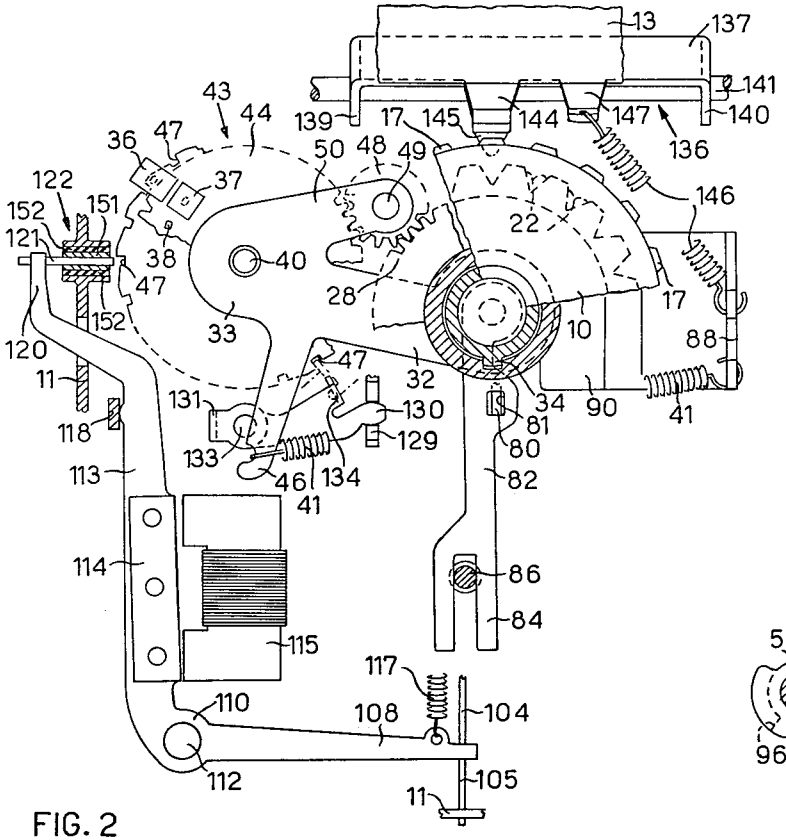
FIG. 2 is a plan view, partly in section, of the printing device.

Both the head 10 and the gear 28 are mounted rotatably on a spindle 29 which has a lower part 30 thereof fixed to an arm 32 of a control lever 33 (FIG. 2). Moreover, in order to prevent relative rotation between the head 10 and the gear 28 (FIG. 3), the hub 19 is provided with a tongue or key 34 normally seated in a corresponding groove 35 in the bush 26. An elastic ring 21 seated in a groove 27 in the spindle 29 prevents possible axial movements of the gear 28.

The lever 33 (FIGS. 1 and 2) is pivoted on the top of a through spindle 40 which is fixed to a horizontal plate 42 of the carriage 11. On that part of the spindle 40 which projects below the plate 42 there is rotatably mounted a selector wheel 43 which is shaped so as to have a spur-toothed ring gear 44 at the top, a ring bevel gear 45 at the bottom and, in the intermediate zone, which is of larger diameter, a plurality of regularly spaced peripheral notches 47 adapted to be detected by a sensor 36, the pulses of which can be counted by a position counter, not shown in the drawings, in a manner known per se. Finally, another sensor 37 is adapted to detect a slot 38 formed in the gear 44 to supply a synchronizing pulse to the position counter in a manner known per se in correspondence with a zero position of the head 10.

The ring gear 44 is in mesh with an intermediate gear 48 which is pivoted on a pin 49 carried by an arm 50 of the lever 33 and also meshes with the gear 28. A spring 41 is stretched between a projection 46 of the lever 33 and a bracket 88 mounted on the plate 42 of the carriage 11. The bracket 88 is provided with a shoe or holder 90 which is inserted in a circumferential groove 91 formed in the hub 19 of the head 10 and is adapted to prevent possible axial movements of the latter.

Figure 5:
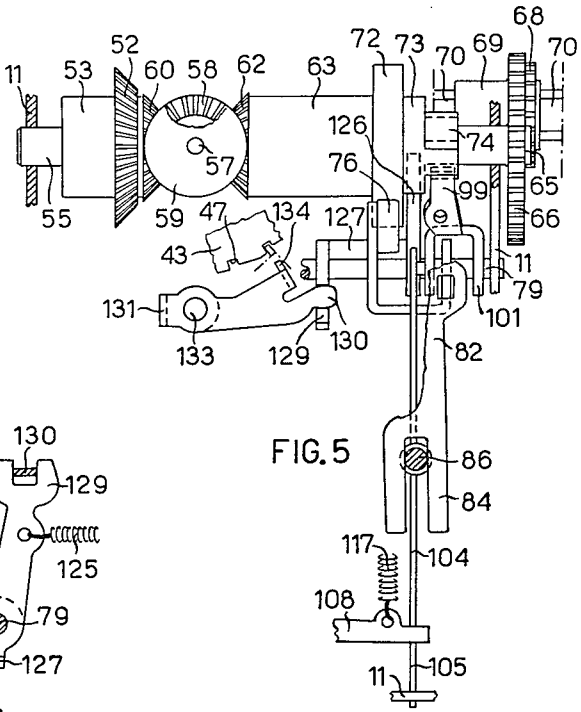
FIG. 5 is a section on the line V—V of FIG. 1.

The ring bevel gear 45, on the other hand, meshes with a corresponding ring bevel gear 52 of a wheel 53 mounted to be freely rotatable on a shaft 55 which, in turn, is mounted rotatably in the sides of the carriage 11 (FIGS. 1 and 5). A through spindle 57 is fixed at right angles to the shaft 55 and carries rotatably on its ends two planetary gears 58 and 59 which are constantly in engagement with a crown wheel 60 constituted by a second ring bevel gear of the wheel 53. The planetary gears 58 and 59 are also in mesh with another crown wheel 62 constituted by a ring bevel gear formed on a cylinder 63, which in turn is arranged coaxially with the shaft 55 and is freely rotatable thereon.

Keyed to one end 65 thereof the shaft 55 carries a gear 66 which is in mesh with a pinion 68 and a bush 69. This bush 69 is mounted rotatably on the carriage 11 and slides on a splined shaft 70 mounted rotatably in a fixed frame 71 of the machine in which the printing device is employed. The shaft 70 is driven by a motor (not shown).

Figure 3:
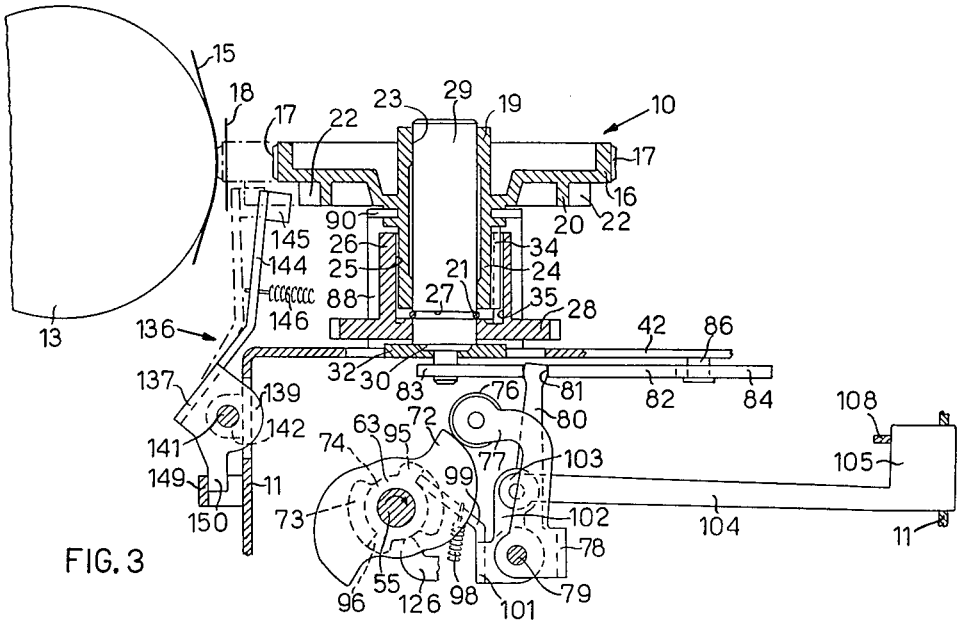
FIG. 3 is a section on the line III—III of FIG. 1.

The cylinder 63 acts as part of a striking mechanism and is shaped in such manner as to define three cams 72, 73 and 74 (FIGS. 3 and 5). A roller 76 rotatable on the end of an arm 77 of a bail 78 pivoted on a shaft 79 fixed to the carriage 11 normally co-operates with the cam 72. An arm 80 of the bail 78 has its end seated in an opening 81 of a slider 82 which, in turn, has one end 83 connected to the lower part 30 of the spindle 29 and one end 84, which is forked, guided by a pin 86 fixed to the upper plate 42 of the carriage 11.

The cam 74 comprises two stop teeth 95 and 96 offset angularly from one another by 180°. By the action of a spring 98, a tongue 99 of a bail 101 normally co-operates with these teeth 95 and 96, the bail 101 being pivoted on the shaft 79 and provided with a lug 102 connected to the end 103 of a slider 104. This slider 104 (FIG. 2) has a terminal lug 105 guided in the carriage 11 and normally co-operating with an arm 108 of a bell-crank lever or change-over element 110.

The lever 110 is pivoted on a pin 112 of the carriage 11 and carries fixed to another arm 113 thereof an armature 114 of an electromagnet 115 supported by the carriage 11. A return spring 117 normally holds the armature 114 spaced from the core of the electromagnet 115 and the lever 110 bearing against a stop 118 provided on the carriage 11. One end 120 of the arm 113 is connected to a tongue 121 which is slidable in a guide block 122 carried by the carriage 11 and is adapted to engage in a notch 47 of the selector wheel 43.

Figure 4:
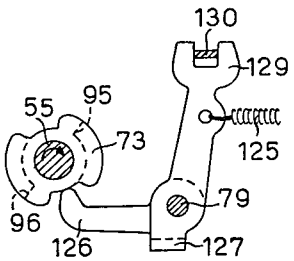
FIG. 4 is a section on the line IV—IV of FIG. 1.

Under the action of a spring 125 (FIG. 4), an arm 126 of a bail 127 normally co-operates with the cam 73, the bail 127 being pivoted on the shaft 79 and having an arm 129 with its end forked and engaging with a projection 130 (FIG. 2) of a lever 131. This lever 131 is pivoted on a pin 133 of the carriage 11 and has a stop tooth 134 which acts as a positioning element and which is adapted to co-operate with the notches 47 of the selector wheel 43.

In the rear part of the carriage 11, between the head 10 and the platen 13, there is arranged a positioning element 136 (FIG. 3) which comprises a bail 137 provided with two lateral lugs 139 and 140 (FIG. 2) pivoted on a spindle 141 supported in turn by lugs 142 of the carriage 11. The bail 137 has an upper arm 144 at the end of which there is arranged a wedge 145 adapted to co-operate with the V-shaped notches 22 of the head 10. A spring 146 stretched between a projection 147 of the bail 137 and the angular member 88 keeps the arm 144 biased towards the head 10, with a bottom tail 150 (FIG. 3) of the bail 137 bearing against a stop 149 on the carriage 11.

Under inoperative conditions, the shaft 70 (FIG. 1) is stationary and the electromagnet 115 (FIG. 2) is not energized. The spring 117 therefore holds the lever 110 bearing against the stop 118 and the tongue 121 spaced from the selector wheel 43. By means of the lever 33, the slider 82 and the bail 78 (FIG. 3), the spring 41 holds the roller 76 against the high profile of the cam 72. In this way, the head 10 is spaced from the platen 13. Moreover, the spring 98 holds the tongue 99 of the bail 101 in engagement with the tooth 95 of the cam 74.

To effect the printing of one or more characters on the support 15, the driving shaft 70 (FIG. 1) is set in rotation and, in each position of the carriage along the printing line, through the medium of the gears 68 and 66, transmits the motion to the shaft 55, which rotates clockwise in FIG. 3. The spindle 57, rotating with the shaft 55, causes the planetary gears 58 and 59 to roll on the crown wheel 62 of the cylinder 63, which is kept stationary by the action of the tongue 99 on the tooth 95. In this way, the wheel 53 rotates with the shaft 55 and transmits the motion to the selector wheel 43 which, through the medium of the intermediate gear 48, causes the printing head 10 to rotate in turn.

The selector wheel 43 and the head 10 turn in the same direction and every time a type or character 17 comes to be located in the printing position, in front of the support 15, a corresponding notch 47 comes to be located in front of the selector tongue 121. When the counter connected to the sensor 36 (FIG. 2) detects that the character 17 selected for printing is in the printing position, a corresponding actuating circuit, not shown in the drawings, energizes the electromagnet 115 in known manner and the electromagnet, attracting the armature 114 to itself, produces clockwise rotation of the lever 110. The slider 104 (FIG. 3) is then shifted to the right by the arm 108 and thus removes the tongue 99 from the tooth 95. At the same time, the end 120 of the arm 113 (FIG. 2) pushes the tongue 121 to the right until it causes it to engage in the corresponding notch 47.

Under these conditions, with the selector wheel 43 locked and the cylinder 63 (FIG. 1) free to turn, the planetary gears 58 and 59, rolling on the crown wheel 60 of the wheel 53, which is stationary, transmit the motion to the crown wheel 62 and, therefore, to the cylinder 63, which is therefore rotated clockwise (FIG. 3) at a speed twice that of the shaft 55. After a few degrees of rotation of the cam 72, the roller 76 is located in correspondence with the low profile of this cam, and the bail 78, as a result of the action of the spring 41, turns sharply anticlockwise. The slider 82 then shifts to the left and the head 10 begins to move towards the platen 13. The cam 73 (FIG. 4), on the other hand, causes its high profile to co-operate with the arm 126 of the bail 127 and causes the latter to turn anticlockwise in opposition to the action of the spring 125. In this way, the projection 130 of the lever 131 is shifted to the left and the lever 131 itself (FIG. 2) is caused to turn anticlockwise about the pin 133. The stop tooth 134 thus co-operates with the corresponding notch 47 which has stopped in front of it. At this point, that is, after some milliseconds following its energization, the electromagnet 115 can be deenergized, it being no longer essential to keep the selector wheel 43 locked by the tongue 121. The spring 117 brings the lever 110 back to the inoperative state, causing it to turn anticlockwise until it is caused to be arrested against the stop 118.

In the meantime, the head 10, being mounted on the arm 32 of the lever 33, approaches the platen 13 following a path in the form of a circular arc, while the selected character 17, because of the presence of the intermediate gear 48, moves towards the support 15 following a substantially rectilinear path.

During the stroke of approach of the head 10 to the platen 13, before the character 17 is brought into contact with the inked ribbon 18, the wedge 145 is inserted in the V-shaped notch 22 corresponding to the selected character 17, correcting the position of the character to be printed.

Due to the action of the spring 98, the slider 104 (FIG. 3) has been shifted to the left and the tongue 99 is brought back to co-operate with the low profile of the cam 74, ready to co-operate with the tooth 96 after a 180° rotation of the cylinder 63. In fact, during this 180° rotation, the complete printing cycle takes place.

After the head 10 has been urged sharply towards the platen 13 and has imprinted the selected character 17 on the support 15, it returns slowly to rest. Thus the roller 76, after a clockwise rotation of about 80° of the cam 72, returns to co-operate with the high profile of the latter and the bail 78 is thus caused to turn clockwise towards the inoperative position.

The printing cycle having been completed, after a 180° rotation of the cylinder 63 and its cams 72, 73 and 74, the arm 126 (FIG. 4) of the bail 127 returns to co-operate with the low profile of the cam 73 and the tooth 134 (FIG. 2) of the lever 131 is brought back out of the notch 47, thus releasing the selector wheel 43. At the same time, the tongue 99, co-operating with the tooth 96, arrests the rotation of the cylinder 63. The device therefore returns to the initial conditions, ready for the printing of a succeeding character.

It is therefore clear that the stop tooth 134 is commanded by the actuated cylinder 63 and keeps the selector wheel 43 and the head 10 locked during the striking action of the character 17 selected and that spring 117 acts on the lever 110 to release the head 10 and the selector wheel 43 immediately after the actuation of the cylinder 63.

It is understood that various modifications may be made in the printing device hereinbefore described without departing from the scope of the claims. In particular, in order to deaden the noise and rebounding of the selector tongue 121 on the actuation thereof, it may be mounted on the frame 11 by means of a metal guide bush 151 at the sides of which two rubber blocks 152 (FIG. 2) are arranged.

Moreover, instead of the type head described hereinbefore may be used an head carrying a plurality of movable characters of the type described in the U.S. Pat. application Ser. No. 494,422 filed on Aug. 5, 1974 now U.S. Pat. No. 3,941,229. In this case the striking mechanism comprises an hammer which mouves only the selected character with respect to the head. Moreover, instead of the differential mechanism described hereinbefore, a clutch system may be used for transferring the motion from the driving shaft alternately to the head or to the striking mechanism.

What I claim is:

1. In a serial printing device for typewriters, accounting machines, teleprinters, and similar office machines, comprising a platen, a carriage mounted adjacent to said platen, a type head mounted on said carriage and carrying a plurality of characters thereon, said type head being rotatably movable and laterally movable between a rest position and a printing position, and continuously rotating driving means, the combination of:

first means for connecting said head to said driving means for continuously rotating said head to sequentially present said characters in front of said platen;

arresting means operatively interconnected to said first means for selectively operating said first means and operatively interconnected with said head for arresting the rotation of said head so as to position a selected character of said plurality of characters in front of said platen;

a striking mechanism connectable to said head and selectively actuatable for moving said head towards said platen to said printing position;

second means for connecting said driving means to said striking mechanism for the actuation thereof;

actuating means for alternately operating said first and said second connecting means for selectively actuating either said arresting means or said striking mechanism;

a first arrest element operated by said actuating means for normally keeping at rest said striking mechanism during the rotation of the head;

a second arrest element operated by said striking mechanism for keeping said head locked during the striking movement thereof in the position at which it was arrested by said arresting means; and restoring means for releasing said arresting means upon operation of said second arrest element whereby said second arrest means replaces said arresting means until completion of the striking movement of the head.

2. A serial printing device according to claim 1, wherein said first means comprise a selector wheel having a plurality of regularly spaced peripheral notches and wherein said arresting means comprises a first tooth engageable with said notches.

3. A serial printing device according to claim 2, wherein said second means comprise a cam cooperating with said first arrest element and wherein said actuating means comprise an electromagnet having an armature connected with said first tooth and with said first arrest element for coincidentally arresting said head and releasing said cam for a striking movement of said striking mechanism.

4. A serial printing device for typewriters, accounting machines, teleprinters and similar office machines, said device comprising:

a platen;

a carriage mounted adjacent to said platen;

a type head mounted on said carriage and carrying a plurality of characters thereon; said head being rotatably movable to position said characters for printing and being laterally movable in a striking movement between a rest position spaced from said platen and a printing position adjacent to said platen;

a continuously rotating driving shaft;

actuatable striking means engageable with said head for causing a striking movement of said head towards said platen;

a differential mechanism having an input connected to said driving shaft, a first output connected to said head for continuously rotating said head to sequentially present said characters in front of said platen and a second output connected to said striking means for effecting a striking movement of said head towards said platen;

arresting means for normally arresting said second output whereby the motion of said driving shaft is transferred by said differential mechanism to said first output causing the rotation of said head;

actuatable change-over means movable from a rest position to a work position and engageable with said differential mechanism for jointly arresting said first output and releasing said second output, thereby stopping the rotation of said head and actuating said striking means for a striking cycle of said head; and restoring means cooperative with said change-over means for moving said change-over means from said work position to said rest position at the end of said striking cycle.

5. A serial printing device according to claim 4 wherein said second output comprises a driven shaft, and said striking means comprises a cam operatively connected to said driven shaft and means operatively connecting said cam with said head for bringing said head towards said platen when said second output is released and said cam is rotated thereby.

6. A serial printing device for typewriters, accounting machines, teleprinters, and similar office machines, said device comprising:

a platen;

a carriage mounted adjacent to said platen;

a type head mounted on said carriage and carrying a plurality of characters thereon; said type head being rotatably movable and laterally movable in a striking movement between a rest position spaced from said platen and a printing position adjacent to said platen;

arresting means selectively actuatable from a rest position to a work position;

means connecting said arresting means with said type head for arresting the rotation thereof to position a selected one of said characters in front of said platen when said arresting means is in said work position;

actuating means for actuating said arresting means;

a striking mechanism connected to said head and operable to cause a striking movement of said head towards said platen to print said selected character, said striking mechanism comprising locking means engageable with said head for keeping said head locked during the striking movement in the position at which it was arrested by said arresting means;

means operated by said actuating means for actuating said striking mechanism;

restoring means connected to said arresting means for moving said arresting means from said work position to said rest position after the actuation of said actuation means; and driving means connectable to said head for causing the rotation thereof, said driving means comprising a continuously rotating driving shaft, first and second driven shafts mounted rotatably coaxially with said driving shaft and coupled thereto by a differential mechanism, said first driven shaft being connected to said head and said second driven shaft being connected to said striking mechanism;

said arresting means comprising a plurality of stop teeth for jointly arresting said first shaft and releasing said second shaft when said arresting means is in said work position.

7. A serial printing device for typewriters, accounting machines, teleprinters and similar office machines, said device comprising:

a platen;

a carriage mounted adjacent to said platen;

a type head mounted on said carriage and carrying a plurality of characters thereon; said type head being rotatably movable and laterally movable in a striking movement between a rest position spaced from said platen and a printing position adjacent to said platen;

driving means connectable to said head for causing the rotation thereof;

arresting means selectively actuatable from a rest position to a work position;

means connecting said arresting means with said type head for arresting the rotation thereof to position a selected character in front of said platen when said arresting means is in said work position;

actuating means for actuating said arresting means;

a striking mechanism connected to said head and actuatable for causing a striking movement thereof towards said platen for the printing of said selected character, said striking mechanism comprising locking means engageable with said head for keeping said head locked during the striking movement in the position at which it was arrested by said arresting means;

means actuatable by said actuating means for actuating said striking mechanism;

restoring means connectable to said arresting means for moving said arresting means from said work position to said rest position after the actuation of said actuating means; and a selector wheel connected to said head and provided with a plurality of regularly spaced peripheral notches, said arresting means comprising first and second stop teeth; said first stop tooth engaging one of said notches and said second tooth releasing said striking mechanism for a single cycle of operation thereof when said actuating means is actuated.

8. A printing device according to claim 7, wherein said striking mechanism comprises a striking cam, a positioning cam and a one-cycle clutch controlled by the said second stop tooth, said striking cam effecting the striking of the selected character and the positioning cam actuating said locking means to keep said head arrested after the starting of the one-cycle clutch.

9. A printing device according to claim 7, wherein said locking means comprises a third tooth adapted to engage a notch of said selector wheel.

10. A printing device according to claim 7, wherein said first stop tooth is movably mounted in a resiliently mounted guide.

11. A printing device according to claim 10, wherein said first stop tooth comprises a tongue slidable in a rigid guide, said mounted guide comprising resilient blocks supporting said rigid guide and fixed to said base member.

12. A serial printing device for typewriters, accounting machines, teleprinters, and similar office machines, said device comprising:

a platen;

a carriage mounted adjacent to said platen;

a type head rotatably mounted on said carriage and carrying a plurality of characters thereon; said type head being rotatably movable and laterally movable in a striking movement between a rest position spaced from said platen and a printing position adjacent to said platen;

driving means connectable with said head for causing the rotation thereof;

arresting means selectively actuatable from a rest position to a work position;

means connecting said arresting means with said type head for arresting the rotation thereof to position a selected character in front of said platen when said arresting means is in said work position;

actuating means comprising an electromagnet mounted on said carriage and having its armature connected to said arresting means for the actuation thereof;

a striking mechanism connected to said head and operable to cause a striking movement of said head toward said platen for the striking of said selected character, said striking mechanism comprising locking means engageable with said head for keeping said head locked during the striking movement in the position at which it was arrested by said arresting means;

means actuatable by said actuating means for actuating said striking mechanism;

restoring means connected to said arresting means for moving said arresting means from said work position to said rest position after the actuation of said actuating means; and synchronizing means operatively interconnected to said head to detect when said selected character is in said printing position, a stop element engageable with said actuating means for normally keeping said striking mechanism arrested, wherein said electromagnet is energized by said synchronizing means for simultaneously disengaging said stop element from said striking mechanism and bringing said arresting means toward said work position.

* * * * *